US009019321B2

(12) United States Patent
Lee

(10) Patent No.: US 9,019,321 B2
(45) Date of Patent: Apr. 28, 2015

(54) GRADATION VOLTAGE GENERATOR AND DISPLAY DEVICE HAVING THE SAME

(75) Inventor: Kwang-Sae Lee, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 668 days.

(21) Appl. No.: 13/137,898

(22) Filed: Sep. 21, 2011

(65) Prior Publication Data

US 2012/0169779 A1 Jul. 5, 2012

(30) Foreign Application Priority Data

Dec. 29, 2010 (KR) ..... 10-2010-0138036

(51) Int. Cl.
*G09G 5/10* (2006.01)

(52) U.S. Cl.
CPC ..... *G09G 5/10* (2013.01)

(58) Field of Classification Search
CPC ..... G09G 5/10
USPC ..... 345/87, 89, 209, 690
See application file for complete search history.

(56) References Cited

U.S. PATENT DOCUMENTS

| | | | | |
|---|---|---|---|---|
| 7,783,105 | B2 | 8/2010 | Moore et al. | |
| 2002/0109619 | A1* | 8/2002 | Lee | 341/138 |
| 2002/0145598 | A1* | 10/2002 | Shen et al. | 345/209 |
| 2003/0201959 | A1* | 10/2003 | Sakaguchi | 345/87 |
| 2008/0259013 | A1 | 10/2008 | Kobayashi | |
| 2010/0001984 | A1* | 1/2010 | Kim et al. | 345/212 |
| 2010/0225678 | A1* | 9/2010 | Kim et al. | 345/690 |
| 2010/0289827 | A1* | 11/2010 | Chen | 345/690 |
| 2010/0295874 | A1* | 11/2010 | Liu et al. | 345/690 |

FOREIGN PATENT DOCUMENTS

| | | | |
|---|---|---|---|
| JP | 2008-268464 | A | 11/2008 |
| KR | 2003-0093835 | A | 12/2003 |
| KR | 10 2005-0028662 | A | 3/2005 |
| KR | 10 2005-0049653 | A | 5/2005 |
| KR | 10 2009-0018207 | A | 2/2009 |

* cited by examiner

*Primary Examiner* — Quan-Zhen Wang
*Assistant Examiner* — Tony Davis
(74) *Attorney, Agent, or Firm* — Lee & Morse, P.C.

(57) ABSTRACT

Embodiments may be directed to a gradation voltage generator and a display device having the same. The display device may include a gradation voltage generator including a first reference voltage selecting unit, which selects a highest reference voltage, a second highest reference voltage, a lowest reference voltage, and a second lowest reference voltage from among a plurality of first voltages between a first power voltage and a second power voltage; a second reference voltage selecting unit, which receives the highest reference voltage and the lowest reference voltage and selects and outputs a first gradation voltage and a N−1th gradation voltage; a gamma voltage selecting unit, which receives the second highest reference voltage and the second lowest reference voltage and generates a plurality of gamma voltages; and a gradation distributing unit, which receives the plurality of gamma voltages and generates second through N−1th gradation voltages.

22 Claims, 6 Drawing Sheets

GRADATION VOLTAGE GENERATOR AND DISPLAY DEVICE HAVING THE SAME

CROSS-REFERENCE TO RELATED PATENT APPLICATION

This application claims the benefit of Korean Patent Application No. 10-2010-0138036, filed on Dec. 29, 2010, in the Korean Intellectual Property Office, the disclosure of which is incorporated herein in its entirety by reference.

BACKGROUND

1. Field

Embodiments relate to a gradation voltage generator and a display device having the same.

2. Description of the Related Art

A liquid crystal display (LCD) device displays an image by controlling light transmittances of liquid crystal cells according to video signals, and more particularly, displays an image by applying analog gradation voltages to pixels by using thin-film transistors (TFTs).

Generally, a LCD device adjusts voltage levels of data voltages to display an image appropriate for a LCD panel having unique gamma characteristics. A gradation voltage generator of a LCD device controls voltage levels of the data voltages by adjusting voltage levels of each of the gradation voltages.

Accordingly, a LCD device may display an image appropriate for a LCD panel having unique gamma characteristics by adjusting voltage levels of each of the gradation voltages.

SUMMARY

Embodiments may be directed to a display device.

According to an embodiment, there may be a gradation voltage generator including a first reference voltage selecting unit, which selects a highest reference voltage, a second highest reference voltage, a lowest reference voltage, and a second lowest reference voltage from among a plurality of first voltages between a first power voltage and a second power voltage; a second reference voltage selecting unit, which receives the highest reference voltage and the lowest reference voltage and selects and outputs a first gradation voltage and a $N-1^{th}$ gradation voltage; a gamma voltage selecting unit, which receives the second highest reference voltage and the second lowest reference voltage and generates a plurality of gamma voltages; and a gradation distributing unit, which receives the plurality of gamma voltages and generates second through $N-1^{th}$ gradation voltages.

The first reference voltage selecting unit includes a power distributor, which connects the first power voltage and the second power voltage and generates the plurality of first voltages; a first voltage selector, which selects one of the plurality of first voltages according to a first control signal and outputs a first selected voltage as the highest reference voltage; a second voltage selector, which selects one of the plurality of first voltages according to the first control signal and outputs a second selected voltage as the second highest reference voltage; a third voltage selector, which selects one of the plurality of voltages according to a second control signal and outputs a third selected voltage as the lowest reference voltage; and a fourth voltage selector, which selects one of the plurality of first voltages according to the second control signal and outputs a fourth selected voltage as the second lowest reference voltage.

The second reference voltage selecting unit includes a fifth voltage selector, which outputs the highest reference voltage as the first gradation voltage according to a third control signal; and a sixth voltage selector, which outputs the lowest reference voltage as the $N^{th}$ gradation voltage according to a fourth control signal.

The gamma voltage selecting unit includes a gamma distributor, which connects the second highest reference voltage and the second lowest reference voltage and generates a plurality of second voltages; and a plurality of voltage selectors, which generate the plurality of gamma voltages based on the plurality of second voltages.

According to another embodiment, there may be a gradation voltage generator including a reference voltage selecting unit, which selects a highest reference voltage and a lowest reference voltage from among a plurality of first voltages between a first power voltage and a second power voltage and outputs the highest reference voltage and the lowest reference voltage as a first gradation voltage and an $N^{th}$ gradation voltage and selects and outputs a second highest reference voltage and a second lowest reference voltage from among the plurality of first voltages; a slope selecting unit, which receives the second highest reference voltage and the second lowest reference voltage and selects and outputs a first intermediate voltage and a second intermediate voltage; a gamma voltage selecting unit, which receives the second highest reference voltage, the second lowest reference voltage, the first intermediate voltage, and the second intermediate voltage and generates a plurality of gamma voltages; and a gradation distributing unit, which receives the plurality of gradation voltages and generates second through $N-2^{th}$ gradation voltages.

The reference voltage selecting unit includes a first power distributor, which connects the first power voltage and the second power voltage and generates the plurality of first voltages; a first voltage selector, which selects one of the plurality of first voltages according to a first control signal and outputs a first selected voltage as the highest reference voltage; a second voltage selector, which selects one of the plurality of first voltages according to the first control signal and outputs a second selected voltage as the second highest reference voltage; a third voltage selector, which selects one of the plurality of first voltages according to the second control signal and outputs a third selected voltage as the lowest reference voltage; and a fourth voltage selector, which selects one of the plurality of first voltages according to a second control signal and outputs a fourth selected voltage as the second lowest reference voltage.

The slope selecting unit includes a second power distributor, which connects the second highest reference voltage and the second lowest reference voltage and generates a plurality of second voltages; a first slope selector, which selects one of the plurality of second voltages according to a third control signal and outputs the first intermediate voltage; and a second slope selector, which selects one of the plurality of second voltages according to a fourth control signal and outputs the second intermediate voltage.

The gamma voltage selecting unit includes a gamma distributor, which connects the second highest reference voltage, the first intermediate voltage, the second intermediate voltage, and the second lowest reference voltage and generates a plurality of third voltages; and a plurality of voltage selectors, which select and output the plurality of gamma voltages from among the plurality of third voltages.

According to another embodiment, there may be a display device including a display panel; a gradation voltage generator, which generates a highest reference voltage, a second highest reference voltage, a lowest reference voltage, and a second lowest reference voltage based on a first power voltage and a second power voltage, generates a first gradation voltage and a $N^{th}$ gradation voltage based on the highest reference voltage and the lowest reference voltage, and generates second through $N-1^{th}$ gradation voltages based on first through $M^{th}$ gamma voltages generated by distributing voltages between the second highest reference voltage and the second lowest reference voltage; and a source driver, which is connected to a plurality of data lines of the display panel and applies data voltages generated based on first through $N^{th}$ gradation voltages to the plurality of data lines.

BRIEF DESCRIPTION OF THE DRAWINGS

The above and other features of present embodiments will become more apparent by describing in detail exemplary embodiments thereof with reference to the attached drawings in which.

DETAILED DESCRIPTION

Example embodiments will now be described more fully hereinafter with reference to the accompanying drawings; however, they may be embodied in different forms and should not be construed as limited to the embodiments set forth herein.

While such terms as "first," "second," etc., may be used to describe various components, such components must not be limited to the above terms. The above terms are used only to distinguish one component from another.

The terms used in the present specification are merely used to describe particular embodiments, and are not intended to present embodiments. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 1:
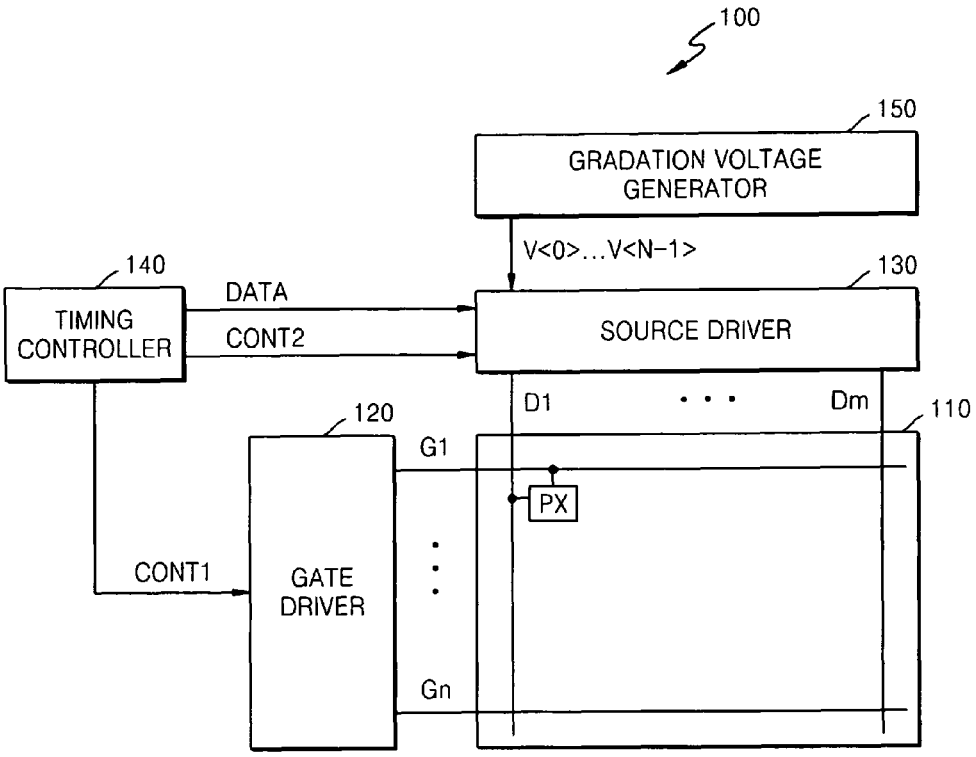
FIG. 1 is a block diagram showing a display device according to an embodiment.
Figure 2:
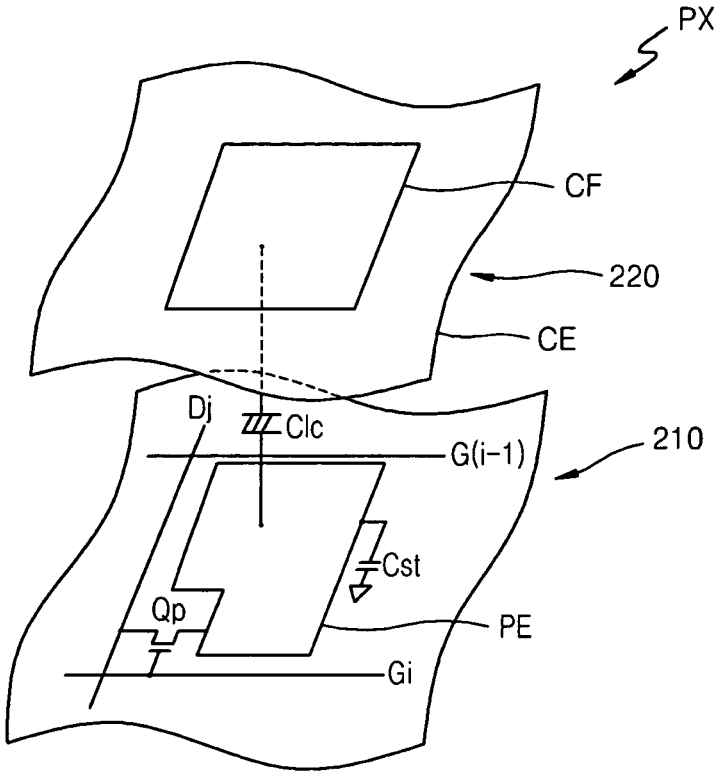
FIG. 2 is a diagram showing the structure of a pixel according to an embodiment.

FIG. 1 is a block diagram showing a display device according to an embodiment. FIG. 2 is a diagram showing the structure of a pixel PX according to an embodiment.

Referring to FIG. 1, a liquid crystal display (LCD) device 100 according to an embodiment may include a LCD panel 110, a gate driver 120, a source driver 130, a timing controller 140, and a gradation voltage generator 150.

The LCD device 100 drives the LCD panel 110 by providing first through $N^{th}$ gradation voltages V<0> through V<N−1> to the source driver 130 by using the gradation voltage generator 150, applying a data voltage Vd to data lines D1 through Dm of the LCD panel 110 by using the source driver 130, and applying a gate voltage Vg to gate lines G1 through Gn of the LCD panel 110 by using the gate driver 120. Furthermore, the LCD device 100 controls the gate driver 120 and the source driver 130 by providing a gate control signal CONT1 and a data control signal CONT2 to the gate driver 120 and the source driver 130, respectively, by using the timing controller 140.

The LCD panel 110 includes the plurality of gate lines G1 through Gn, the plurality of data lines D1 through Dm, and a plurality of pixels PX. The plurality of gate lines G1 through Gn are arranged in separate rows and each of the plurality of gate lines G1 through Gn transmits a gate voltage. The plurality of data lines D1 through Dm are arranged in separate columns and each of the plurality of data lines D1 through Dm transmits a data voltage. The plurality of gate lines G1 through Gn and the plurality of data lines D1 through Dm are arranged in a matrix form, where a pixel PX is formed at each of the points where each of the plurality of gate lines G1 through Gn and each of the plurality of data lines D1 through Dm cross.

Referring to FIG. 2, the pixel PX of FIG. 1 will be described below. The LCD panel 110 is formed by interposing a liquid crystal layer (not shown) between a first substrate 210 and a second substrate 220. The plurality of gate lines G1 through Gn, the plurality of data lines D1 through Dm, a pixel switching device Qp, and a pixel electrode PE are formed on the first substrate 210. A color filter CF and a common electrode CE are formed on the second substrate 220. Unlike the embodiment shown in FIG. 2, the color filter CF may be arranged on or below the pixel electrode PE on the first substrate 210.

For example, the pixel PX connected to an $i^{th}$ gate line Gi (i is a natural number equal to or greater than 1 and smaller than or equal to n) and a $j^{th}$ data line Dj (j is a natural number equal to or greater than 1 and smaller than or equal to m) includes a pixel switching device Qp, which includes a gate electrode connected to the gate line Gi, a first electrode connected to the data line Dj, and a second electrode connected to the pixel electrode PE, and a liquid crystal capacitor Clc and a storage capacitor Cst which are coupled with the second electrode of the pixel switching device Qp via the pixel electrode PE.

The liquid crystal capacitor Clc is formed of two electrodes, i.e., the pixel electrode PE of the first substrate 210 and the common electrode CE of the second electrode 220, and includes the liquid crystal layer as a dielectric between the two electrodes. A common voltage Vcom is applied to the common electrode CE. Light transmittance of the liquid crystal layer is controlled according to a voltage applied to the pixel electrode PE, and thus brightness of each of the pixels PX is controlled.

The pixel electrode PE may be connected to the data line Dj via the pixel switching device Qp. When the gate electrode is connected to the gate line Gi and a gate on voltage Von is applied to the gate line Gi, the pixel switching device Qp is turned on and applies a data voltage transmitted via the data line Dj to the pixel electrode PE.

The storage capacitor Cst is formed of the pixel electrode PE and a separate signal line (not shown) formed on the first substrate 210 in parallel to the gate line Gi, e.g., a storage line, an insulator is disposed between the pixel electrode PE and a storage line. The common voltage Vcom or a predetermined voltage for the storage capacitor Cst may be applied to the separate signal line.

The pixel switching device Qp may be a thin-film transistor (TFT) formed of amorphous silicon.

Referring back to FIG. 1, the gate driver 120 may generate gate voltages Vg, which are combinations of active level gate on voltages Von and inactive level gate on voltages Voff, and sequentially provide the gate voltages Vg to the LCD panel 110 via the plurality of gate lines G1 through Gn.

The source driver 130 selects a gradation voltage corresponding to an input image data DATA input from the timing controller 140 from among the first through $N^{th}$ gradation voltages V<0> through V<N−1> input from the gradation voltage generator 150 and outputs the selected gradation voltage to the LCD panel 110.

The timing controller 140 receives the input image data DATA and input control signals for controlling display of the input image data DATA from an external graphic controller (not shown). The input control signals include a horizontal synchronization signal Hsync, a vertical synchronization signal Vsync, and a main clock MCLK. The timing controller 140 transmits the input image data DATA to the source driver 130 and generates the gate control signal CONT1 and the data control signal CONT2 and transmits the gate control signal CONT1 and the data control signal CONT2 to the gate driver 120 and the source driver 130, respectively. The gate control signal CONT1 includes a scan initiation signal, which instructs scanning initiation, and a plurality of clock signals, whereas the data control signal CONT2 includes a horizontal synchronization initiating signal, which instructs transmission of input image data to pixels PX in a particular row, and a clock signal.

The gradation voltage generator 150 selects the highest reference voltage and the lowest reference voltage from among a plurality of voltages distributed between a first power voltage and a second power voltage, outputs the highest reference voltage as a first gradation voltage V<0> or an $N^{th}$ gradation voltage V<N−1>, and outputs the lowest reference voltage as the $N^{th}$ gradation voltage V<N−1> or the first gradation voltage V<0>. Furthermore, the gradation voltage generator 150 selects the second highest reference voltage and the second lowest reference voltage from among the plurality of voltages distributed between the first power voltage and the second power voltage, generates first through $M^{th}$ gamma voltages by distributing voltages between the second highest reference voltage and the second lowest reference voltage, and generates second through $N-1^{th}$ gradation voltages based on the first through $M^{th}$ gamma voltages. The gradation voltage generator 150 decides a gamma curve by selecting the first through $M^{th}$ gamma voltages and generates the second through $N-1^{th}$ gradation voltages V<1> through V<N−2> by fixing or adjusting an inflection point of the gamma curve. And the voltage generator 150 outputs the first through $N^{th}$ gradation voltages V<0> through V<N−1> to the source driver 130.

Figure 3:
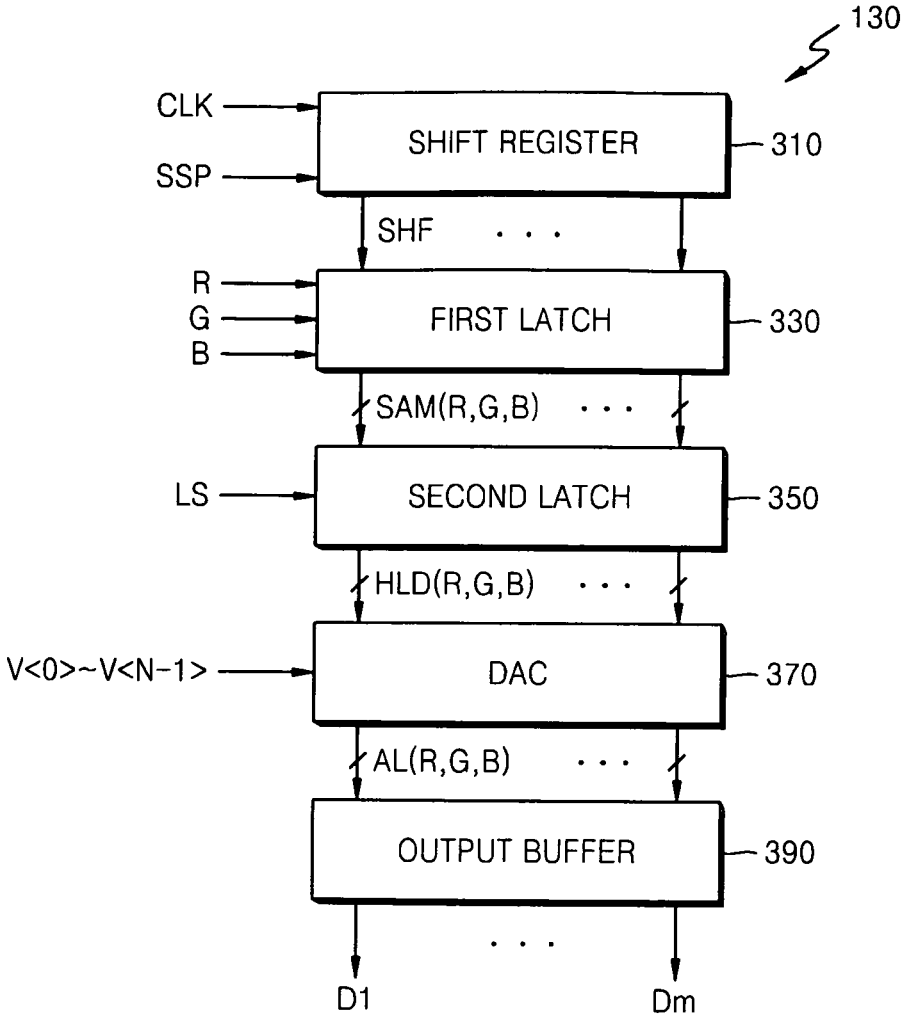
FIG. 3 is a block diagram schematically showing the internal configuration of a source driver according to an embodiment.

FIG. 3 is a block diagram schematically showing the internal configuration of the source driver 130 according to an embodiment.

Referring to FIG. 3, the source driver 130 according to the present embodiment includes a shift register 310, a first latch 330, a second latch 350, a digital-to-analog converter (DAC) 370, and an output buffer 390.

The shift register 310 includes a plurality of flip-flops which are respectively arranged in correspondence to the plurality of data lines D1 through Dm and are sequentially connected in series. The shift register 310 outputs a shift pulse signal SHF by sequentially shifting source start pulse SSP to adjacent flip-flops in synchronization with a clock signal CLK.

The first latch 330 receives digital RGB data and samples and stores the digital RGB data in synchronization with the shift pulse signals SHF output from each of the flip-flops of the shift register 310.

The second latch 350 holds the sampled digital RGB data stored in the first latch 330, in synchronization with a latch signal LS.

The DAC 370 converts digital RGB data output from the second latch 350 to corresponding analog RGB data AL based on the gradation voltages V<0> through V<N−1> provided from the gradation voltage generator 150.

The output buffer 390 buffers the analog RGB data AL from the DAC 370 and outputs the buffered analog RGB data AL to the data lines DL1 through DLm. The output buffer 390 includes operational amplifying circuits OPC respectively arranged in correspondence to the plurality of data lines D1 through Dm, and each of the operational amplifying circuits OPC impedance-converts the analog RGB data from the DAC 370 and outputs the converted analog RGB data to each of the data lines.

Figure 4:
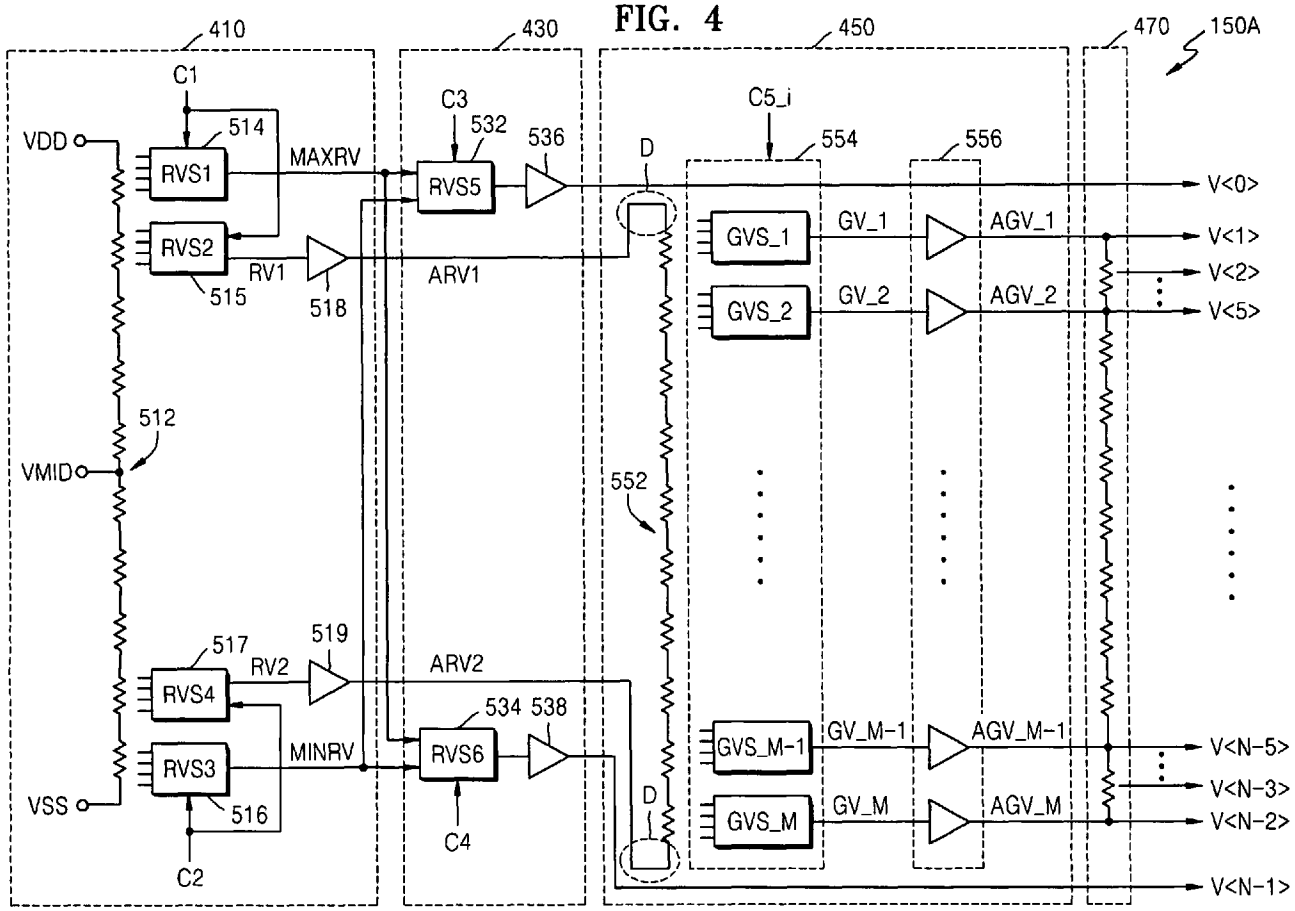
FIG. 4 is a block diagram schematically showing the internal configuration of a gradation voltage generator according to an embodiment.

FIG. 4 is a block diagram schematically showing the internal configuration of a gradation voltage generator 150A according to an embodiment.

Referring to FIG. 4, the gradation voltage generator 150A includes a first reference voltage selecting unit 410, a second reference voltage selection unit 430, a gamma voltage selecting unit 450, and a gradation distributing unit 470.

The first reference voltage selecting unit 410 selects the highest reference voltage MAXRV, the second highest reference voltage RV1, the lowest reference voltage MINRV, and the second lowest reference voltage RV2 from among a plurality of voltages distributed between a first power voltage VDD and a second power voltage VSS and outputs the highest reference voltage MAXRV, the second highest reference voltage RV1, the lowest reference voltage MINRV, and the second lowest reference voltage RV2. The first reference voltage selecting unit 410 includes a power distributor 512 voltage selector RVS1 514, a second reference voltage selector RVS2 515, a third reference voltage selector RVS3 516, a fourth reference voltage selector RVS4 517, a first buffer 518, and a second buffer 519.

The power distributor 512 may be formed of resistor strings and generates a plurality of first voltages by distributing voltages between the first power voltage VDD and the second power voltage VSS.

The first reference voltage selector 514 and the second reference voltage selector 515 respectively select the highest reference voltage MAXRV and the second highest reference voltage RV1 from among the voltages from the first power voltage VDD through the median voltage VMID in response to a first control signal C1 output from a register (not shown). In the same regard, the third reference voltage selector 516 and the fourth reference voltage selector 517 respectively select the lowest reference voltage MINRV and the second lowest reference voltage RV2 from among the voltages from the median voltage VMID through the second power voltage VSS in response to a second control signal C2 output from a register (not shown).

The first buffer 518 and the second buffer 519 may include voltage followers for stably providing voltages. The first buffer 518 receives the second highest reference voltage RV1, buffers the second highest reference voltage RV1, and outputs the second highest reference buffer voltage ARV1. The second buffer 519 receives the second lowest reference voltage RV2, buffers the second lowest reference voltage RV2, and outputs the second lowest reference buffer voltage ARV2.

The second reference voltage selecting unit 430 outputs the highest reference voltage MAXRV output from the first reference voltage selecting unit 410 as the first gradation voltage V<0> and outputs the lowest reference voltage MINRV output from the first reference voltage selecting unit 410 as the $N^{th}$ gradation voltage V<N−1> or outputs the lowest reference voltage MINRV output from the first reference voltage selecting unit 410 as the first gradation voltage V<0> and outputs the highest reference voltage MAXRV output from the first reference voltage selecting unit 410 as the $N^{th}$ gradation voltage V<N−1>. The second reference voltage selecting unit 430 includes a fifth reference voltage selector RVS5 532, a sixth reference voltage selector RVS6 534, a third buffer 536, and a fourth buffer 538.

The fifth reference voltage selector 532 outputs the highest reference voltage MAXRV or the lowest reference voltage MINRV as the first gradation voltage V<0> in response to a third control signal C3. The sixth reference voltage selector 534 outputs the lowest reference voltage MINRV or the highest reference voltage MAXRV as the $N^{th}$ gradation voltage V<N−1> in response to a fourth control signal C4. For example, in the case of outputting 256 gradation voltages, the fifth reference voltage selector 532 may output the first gradation voltage V<0>, and the sixth reference voltage selector 534 may output the $256^{th}$ gradation voltage V<255>.

The third buffer 536 buffers and outputs the first gradation voltage V<0> output from the fifth reference voltage selector 532, whereas the fourth buffer 538 buffers and outputs the $N^{th}$ gradation voltage V<N−1> output from the sixth reference voltage selector 534.

The gamma voltage selecting unit 450 selects first through $M^{th}$ gamma voltages GV_1 through GV_M from among a plurality of voltages generated by distributing voltages between the second highest reference buffer voltage ARV1 and the second lowest reference buffer voltage ARV2, generates the second through $N-1^{th}$ gradation voltages V<1> through V<N−2> from the first through $M^{th}$ gamma voltages GV_1 through GV_M by fixing or adjusting an inflection point of a gamma curve, and outputs the second through $N-1^{th}$ gradation voltages V<1> through V<N−2>. The gamma voltage selecting unit 450 includes a gamma distributor 552, a gamma voltage selector 554, and a buffer unit 556.

The gamma distributor 552 may be formed of resistor strings and generates a plurality of voltages by distributing voltages between the second highest reference buffer voltage ARV1 and the second lowest reference buffer voltage ARV2.

The gamma voltage selector 554 includes first through $M^{th}$ gamma selectors GVS_1 through GVS_M, selects the first through $M^{th}$ gamma voltages GV_1 through GV_M from among a plurality of voltages generated by the gamma voltage distributor 552 in response to a fifth control signal C5_i from a register (not shown), and outputs the first through $M^{th}$ gamma voltages GV_1 through GV_M. For example, in the case of outputting 256 gradation voltages, the gamma voltage selector 554 may include first through eleventh gamma selectors GVS_1 through GVS_11. The first through eleventh gamma selectors GVS_1 through GVS_11 select first through eleventh gamma voltages GV_1 through GV_11 from among a plurality of voltages generated by distributing voltages between the second highest reference buffer voltage ARV1 and the second lowest reference buffer voltage ARV2 in response to fifth control signals C5_1 through C5_11, respectively, and output the first through eleventh gamma voltages GV_1 through GV_11. Here, the number of gamma selectors included in the gamma voltage selector 554 may vary according to a number of gradation voltages V<0> through V<N−1> to be output.

The buffer unit 556 receives the first through $M^{th}$ gamma voltages GV_1 through GV_M output from the first through $M^{th}$ gamma selectors GVS_1 through GVS_M, buffers the first through $M^{th}$ gamma voltages GV_1 through GV_M, and outputs first through $M^{th}$ gamma buffer voltages AGV_1 through AGV_M. Here, buffers of the buffer unit 556 may be voltage followers for stably providing voltages, and the number of the buffers may vary according to the number of gradation voltages V<0> through V<N−1> to be output.

The gradation distributing unit 470 may be formed of resistor strings and generates and outputs the second through $N-1^{th}$ gradation voltages V<1> through V<N−2> by distributing voltages between the first through $M^{th}$ gamma buffer voltages AGV_1 through AGV_M output from the buffer unit 556. For example, in the case of outputting 256 gradation voltages, the gradation distributing unit 470 may output the second through $255^{th}$ gradation voltages V<1> through V<254> by distributing voltages between the first through eleventh gamma buffer voltages AGV_1 through AGV_11.

As indicated by D, the gamma distributor 552 is separated from lines for outputting the first gradation voltage and the $N^{th}$ gradation voltage that are generated based on the highest reference voltage MAXRV and the lowest reference voltage MINRV. Therefore, the highest reference voltage MAXRV and the lowest reference voltage MINRV may be individually adjusted. Furthermore, in the case where the highest reference voltage MAXRV and the lowest reference voltage MINRV are changed, a gamma voltage GV, an internal kickback voltage, and gray color coordinates may not be changed.

Furthermore, the second highest reference voltage RV1 and the second lowest reference voltage RV2 are not used as intermediate level reference voltages (the second gradation voltage and the $N-1^{th}$ gradation voltage), and gamma voltages for generating intermediate level gradation voltages are selected from among a plurality of voltages generated by the gamma distributor 552 to which the second highest reference voltage RV1 and the second lowest reference voltage RV2 are connected. Therefore, intermediate level gradation voltages may be individually adjusted.

Figure 5:
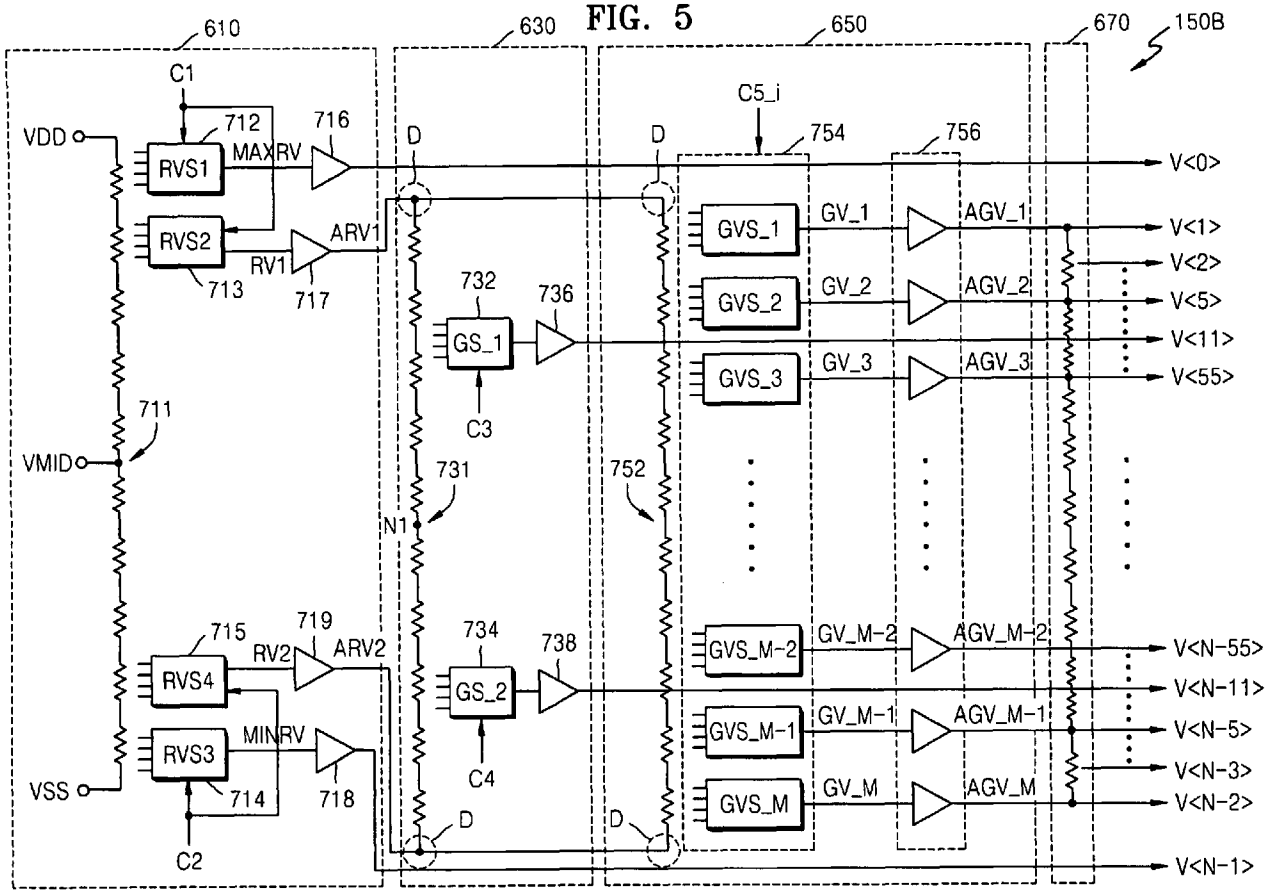
FIG. 5 is a block diagram schematically showing the internal configuration of a gradation voltage generator according to another embodiment.

FIG. 5 is a block diagram schematically showing the internal configuration of a gradation voltage generator 150B according to another embodiment.

Referring to FIG. 5, the gradation voltage generator 150B includes a reference voltage selecting unit 610, a slope selecting unit 630, a gamma voltage selecting unit 650, and a gradation distributing unit 670.

The reference voltage selecting unit 610 selects the highest reference voltage MAXRV, the second highest reference voltage RV1, the lowest reference voltage MINRV, and the second lowest reference voltage RV2 from among a plurality of voltages distributed between the first power voltage VDD and the second power voltage VSS and outputs the highest reference voltage MAXRV, the second highest reference voltage RV1, the lowest reference voltage MINRV, and the second lowest reference voltage RV2 to the slope selecting unit 630. The reference voltage selecting unit 610 includes a first power distributor 711, a highest reference voltage selector RVS1 712, a second highest reference voltage selector RVS2 713, a lowest reference voltage selector RVS3 714, a second lowest reference voltage selector RVS4 715 and first through fourth buffers 716, 717, 718, and 719.

The first power distributor 711 may be formed of resistor strings and generates a plurality of first voltages by distributing voltages between the first power voltage VDD and the second power voltage VSS.

The highest reference voltage selector 712 and the second highest reference voltage selector 713 respectively select and output the highest reference voltage MAXRV and the second highest reference voltage RV1 from among the voltages from the first power voltage VDD through the median voltage VMID in response to the first control signal C1 output from a register (not shown). In the same regard, the lowest reference voltage selector 714 and the second lowest reference voltage selector 715 respectively select and output the lowest reference voltage MINRV and the second lowest reference voltage RV2 from among the voltages from the median voltage VMID through the second power voltage VSS in response to the second control signal C2 output from a register (not shown).

The first through fourth buffers 716 through 719 may include voltage followers for stably providing voltages. The first buffer 716 receives the highest reference voltage MAXRV, buffers the highest reference voltage MAXRV, and outputs the first gradation voltage V<0>. The second buffer 717 receives the second highest reference voltage RV1, buffers the second highest reference voltage RV1, and outputs the second highest reference buffer voltage ARV1 to the slope selecting unit 630. The third buffer 718 receives the lowest reference voltage MINRV, buffers the lowest reference voltage MINRV, and outputs the $N^{th}$ gradation voltage V<N−1>. The fourth buffer 719 receives the second lowest reference voltage RV2, buffers the second lowest reference voltage RV2, and outputs the second lowest reference buffer voltage ARV2 to the slope selecting unit 630.

The slope selecting unit 630 selects and outputs a first intermediate voltage and a second intermediate voltage from among a plurality of voltages generated by distributing voltages between the second highest reference buffer voltage ARV1 and the second lowest reference buffer voltage ARV2. The slope selecting unit 630 includes a second power distributor 731, a first slope selector GS_1 732, a second slope selector GS_2 734, a fifth buffer 736, and a sixth buffer 738.

The second power distributor 731 may be formed of resistor strings and generates a plurality of voltages by distributing voltages between the second highest reference buffer voltage ARV1 and the second lowest reference buffer voltage ARV2.

The first slope selector 732 selects the first intermediate voltage from among a plurality of voltages generated by distributing voltages between the second highest reference buffer voltage ARV1 and a node N1 and outputs the first intermediate voltage to the fifth buffer 736, in response to the third control signal C3 from a register (not shown). The second slope selector 734 selects the second intermediate voltage from among a plurality of voltages generated by distributing voltages between the second lowest reference buffer voltage ARV2 and the node N1 and outputs the second intermediate voltage to the sixth buffer 738, in response to the fourth control signal C4 from a register (not shown).

The fifth buffer 736 and the sixth buffer 738 may include a plurality of voltage followers for stably providing voltages. The fifth buffer 736 and the sixth buffer 738 respectively buffer the first intermediate voltage and the second intermediate voltage and output the buffered first intermediate voltage and the buffered second intermediate voltage to the gamma voltage selecting unit 650.

The gamma voltage selecting unit 650 selects first through $M^{th}$ gamma voltages GV_1 through GV_M from among a plurality of voltages generated by distributing voltages between the second highest reference buffer voltage ARV1 and the second lowest reference buffer voltage ARV2, generates the second through $N-1^{th}$ gradation voltages V<1> through V<N−2> from the first through $M^{th}$ gamma voltages GV_1 through GV_M by fixing or adjusting an inflection point of a gamma curve, and outputs the second through $N-1^{th}$ gradation voltages V<1> through V<N−2>. The gamma voltage selecting unit 650 includes a gamma distributor 752, a gamma voltage selector 754, and a buffer unit 756.

The gamma distributor 752 may be formed of resistor strings and generates a plurality of voltages by distributing voltages between the second highest reference buffer voltage ARV1 and the second lowest reference buffer voltage ARV2.

The gamma voltage selector 754 includes first through $M^{th}$ gamma selectors GVS_1 through GVS_M, selects the first through $M^{th}$ gamma voltages GV_1 through GV_M from among a plurality of voltages generated by the gamma voltage distributor 752 in response to the fifth control signal C5_i from a register (not shown), and outputs the first through $M^{th}$ gamma voltages GV_1 through GV_M. Here, the number of gamma selectors included in the gamma voltage selector 754 may vary according to the number of gradation voltages V<0> through V<N−1> to be output.

The buffer unit 756 receives the first through $M^{th}$ gamma voltages GV_1 through GV_M output from the first through $M^{th}$ gamma selectors GVS_1 through GVS_M, buffers the first through $M^{th}$ gamma voltages GV_1 through GV_M, and outputs the first through $M^{th}$ gamma buffer voltages AGV_1 through AGV_M. Here, buffers of the buffer unit 756 may be voltage followers for stably providing voltages, and the number of the buffers may vary according to the number of gradation voltages V<0> through V<N−1> to be output.

The gradation distributing unit 670 may be formed of resistor strings and generates and outputs the second through $N-1^{th}$ gradation voltages V<1> through V<N−2> by distributing voltages between the first through $M^{th}$ gamma buffer voltages AGV_1 through AGV_M output from the buffer unit 756 and the first and second intermediate voltages. For example, in the case of outputting 256 gradation voltages, the gradation distributing unit 670 may output the second through $255^{th}$ gradation voltages V<1> through V<254>.

As indicated by D, the second power distributor 731 and the gamma distributor 752 are separated from lines for outputting the first gradation voltage and the $N^{th}$ gradation voltage that are generated based on the highest reference voltage MAXRV and the lowest reference voltage MINRV. Therefore, the highest reference voltage MAXRV and the lowest reference voltage MINRV may be individually adjusted. Furthermore, in the case where the highest reference voltage MAXRV and the lowest reference voltage MINRV are changed, a gamma voltage GV, an internal kickback voltage, and gray color coordinates may not be changed.

Furthermore, the second highest reference voltage RV1 and the second lowest reference voltage RV2 are not used as intermediate level reference voltages (the second gradation voltage and the $N-1^{th}$ gradation voltage), and gamma voltages for generating intermediate level gradation voltages are selected from among a plurality of voltages generated by the second power distributor 731 and the gamma distributor 752 to which the second highest reference voltage RV1 and the second lowest reference voltage RV2 are connected. Therefore, intermediate level gradation voltages may be individually adjusted.

Figure 6A:
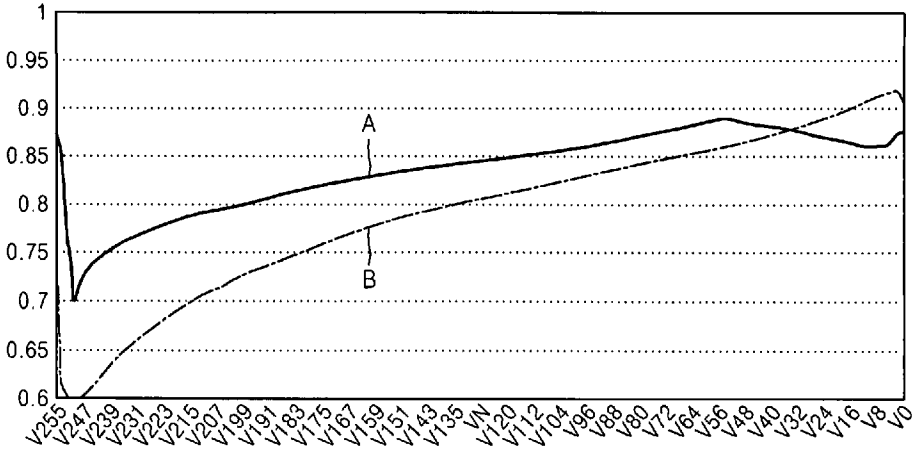
FIGS. 6A and 6B are diagrams showing effects of present embodiments.
Figure 6B:
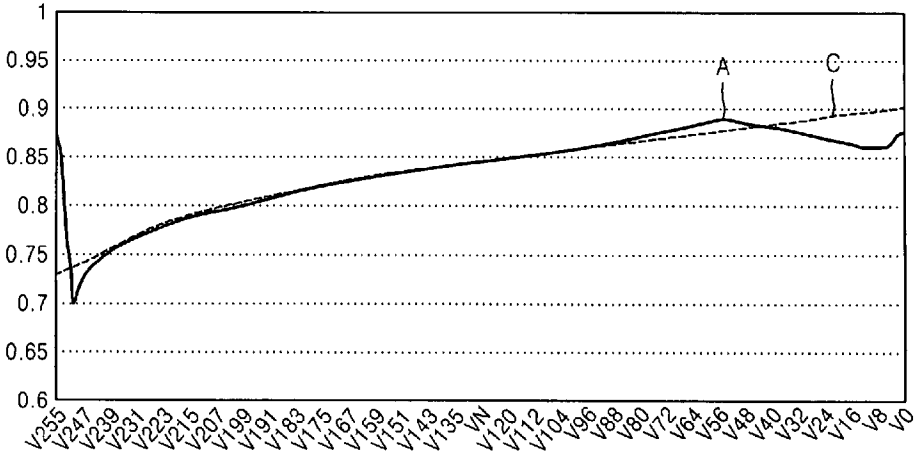

FIGS. 6A and 6B are diagrams showing effects of present embodiments.

FIG. 6A is a graph showing changes of an internal kickback voltage measured in the case of changing the highest reference voltage and the lowest reference voltage in a conventional gradation voltage generator. FIG. 6A shows that the internal kickback voltage is significantly changed (from A to B) in the case where the highest reference voltage and the lowest reference voltage are changed.

FIG. 6B is a graph showing changes of an internal kickback voltage measured in the case of changing the highest reference voltage and the lowest reference voltage in a gradation voltage generator according to present embodiments. FIG. 6B shows that the internal kickback voltage is not changed significantly (from A to C) even in the case where the highest reference voltage and the lowest reference voltage are changed.

Embodiments may be directed to a display device, capable of maintaining a constant internal kickback voltage even if the highest reference voltage and the lowest reference voltage are changed.

A display device according to present embodiments may maintain a gamma voltage GV, an internal kickback voltage, and gray color coordinates constant when the highest reference voltage and the lowest reference voltage, which respectively constitute the highest gradation voltage and the lower gradation voltage, are changed. Thus, a display device according to present embodiments may provide high quality images.

Exemplary embodiments have been disclosed herein, and although specific terms are employed, they are used and are to be interpreted in a generic and descriptive sense only and not for purpose of limitation.

What is claimed is:

1. A gradation voltage generator, comprising:

a first reference voltage selector to select a highest reference voltage, a second highest reference voltage, a lowest reference voltage, and a second lowest reference voltage, from among a plurality of first voltages between a first power voltage and a second power voltage;

a second reference voltage selector to receive the highest reference voltage and the lowest reference voltage, and to select and output a first gradation voltage and an $N^{th}$ gradation voltage;

a gamma voltage selector to receive the second highest reference voltage and the second lowest reference voltage and to generate a plurality of gamma voltages independently from the first gradation voltage and the $N^{th}$ gradation voltage; and a gradation distributor to receive the plurality of gamma voltages and to generate second through $N-1^{th}$ gradation voltages, wherein:

the first gradation voltage and the $N^{th}$ gradation voltage are to be output with the plurality of gamma voltages, the gamma voltage selector includes a gamma distributor, and the first gradation voltage and the $N^{th}$ gradation voltage are output along signal paths that are unconnected to the gamma distributor, and wherein the first reference voltage selector includes:

a power distributor, which connects the first power voltage and the second power voltage and generates the plurality of first voltages;

a first voltage selector, which selects one of the plurality of first voltages according to a first control signal and outputs a first selected voltage as the highest reference voltage;

a second voltage selector, which selects one of the plurality of first voltages according to the first control signal and outputs a second selected voltage as the second highest reference voltage;

a third voltage selector, which selects one of the plurality of first voltages according to a second control signal and outputs a third selected voltage as the lowest reference voltage; and a fourth voltage selector, which selects one of the plurality of first voltages according to the second control signal and outputs a fourth selected voltage as the second lowest reference voltage.

2. The gradation voltage generator of claim 1, wherein the first reference voltage selector includes:

a first buffer, which buffers and outputs the second highest reference voltage; and a second buffer, which buffers and outputs the second lowest reference voltage.

3. The gradation voltage generator of claim 1, wherein the power distributor includes one or more resistor strings.

4. The gradation voltage generator of claim 1, wherein the second reference voltage selector includes:

a fifth voltage selector, which outputs the highest reference voltage as the first gradation voltage according to a third control signal; and a sixth voltage selector, which outputs the lowest reference voltage as the $N^{th}$ gradation voltage according to a fourth control signal.

5. The gradation voltage generator of claim 4, wherein the second reference voltage selector further includes:

a third buffer, which buffers and outputs the first gradation voltage; and a fourth buffer, which buffers and outputs the $N^{th}$ gradation voltage.

6. The gradation voltage generator of claim 1, wherein the gamma voltage selector includes:

the gamma distributor, which connects the second highest reference voltage and the second lowest reference voltage and generates a plurality of second voltages; and a plurality of voltage selectors, which generate the plurality of gamma voltages based on the plurality of second voltages.

7. The gradation voltage generator of claim 6, wherein the gamma voltage selector includes a plurality of buffers which buffer and output the plurality of gamma voltages, and wherein the signal paths of the first gradation voltage and the $N^{th}$ gradation voltage bypass the buffers.

8. The gradation voltage generator of claim 6, wherein the gamma distributor includes one or more resistor strings.

9. The gradation voltage generator of claim 1, wherein the gradation distributor includes one or more resistor strings.

10. The gradation voltage generator of claim 1, wherein an internal kickback voltage, gray color coordinates, and one or more of the gamma voltages are maintained at substantially constant levels when the highest reference voltage and the lowest reference voltage are changed.

11. A gradation voltage generator, comprising:

a reference voltage selector to select a highest reference voltage and a lowest reference voltage from among a plurality of first voltages between a first power voltage and a second power voltage and outputs the highest reference voltage and the lowest reference voltage as a first gradation voltage and an $N^{th}$ gradation voltage, and to select and output a second highest reference voltage and a second lowest reference voltage from among the plurality of first voltages;

a slope selector to receive the second highest reference voltage and the second lowest reference voltage and selects and to output a first intermediate voltage and a second intermediate voltage;

a gamma voltage selector to receive the second highest reference voltage, the second lowest reference voltage, the first intermediate voltage, and the second intermediate voltage and to generate a plurality of gamma voltages independently from the first gradation voltage and the $N^{th}$ gradation voltage; and a gradation distributor to receive the plurality of gradation voltages and to generate second through $N-1^{th}$ gradation voltages wherein:

the first gradation voltage and the $N^{th}$ gradation voltage are to be output with the plurality of gamma voltages, the gamma voltage selector includes a gamma distributor, and the first gradation voltage and the $N^{th}$ gradation voltage are output along signal paths that are unconnected the gamma distributor, and wherein the reference voltage selector includes:

a first power distributor, which connects the first power voltage and the second power voltage and generates the plurality of first voltages;

a first voltage selector, which selects one of the plurality of first voltages according to a first control signal and outputs a first selected voltage as the highest reference voltage;

a second voltage selector, which selects one of the plurality of first voltages according to the first control signal and outputs a second selected voltage as the second highest reference voltage;

a third voltage selector, which selects one of the plurality of first voltages according to a second control signal and outputs a third selected voltage as the lowest reference voltage; and a fourth voltage selector, which selects one of the plurality of first voltages according to the second control signal and outputs a fourth selected voltage as the second lowest reference voltage.

12. The gradation voltage generator of claim 11, wherein the reference voltage selector includes:

a first buffer, which buffers the highest reference voltage and outputs the highest reference voltage as the first gradation voltage;

a second buffer, which buffers and outputs the second highest reference voltage;

a third buffer, which buffers the lowest reference voltage and outputs the lowest reference voltage as the $N^{th}$ gradation voltage; and a fourth buffer, which buffers and outputs the second lowest reference voltage.

13. The gradation voltage generator of claim 11, wherein the first power distributor includes one or more resistor strings.

14. The gradation voltage generator of claim 11, wherein the slope selector includes:

a second power distributor, which connects the second highest reference voltage and the second lowest reference voltage and generates a plurality of second voltages;

a first slope selector, which selects one of the plurality of second voltages according to a third control signal and outputs the first intermediate voltage; and a second slope selector, which selects one of the plurality of second voltages according to a fourth control signal and outputs the second intermediate voltage.

15. The gradation voltage generator of claim 14, wherein the slope selector includes:

a fifth buffer, which buffers and outputs the first intermediate voltage; and a sixth buffer, which buffers and outputs the second intermediate voltage.

16. The gradation voltage generator of claim 14, wherein the second power distributor includes one or more resistor strings.

17. The gradation voltage generator of claim 11, wherein the gamma voltage selector includes:

the gamma distributor, which connects the second highest reference voltage, the first intermediate voltage, the second intermediate voltage, and the second lowest reference voltage and generates a plurality of third voltages; and a plurality of voltage selectors, which select and output the plurality of gamma voltages from among the plurality of third voltages.

18. The gradation voltage generator of claim 17, wherein the gamma voltage selector includes a plurality of buffers, which buffer and output the plurality of gamma voltages.

19. The gradation voltage generator of claim 17, wherein the gamma distributor includes one or more resistor strings.

20. The gradation voltage generator of claim 11, wherein the gradation distributor includes one or more resistor strings.

21. A display device, comprising:

a display panel;

a gradation voltage generator, which generates a highest reference voltage, a second highest reference voltage, a lowest reference voltage, and a second lowest reference voltage based on a first power voltage and a second power voltage, generates a first gradation voltage and a $N^{th}$ gradation voltage based on the highest reference voltage and the lowest reference voltage, and generates second through $N-1^{th}$ gradation voltages independently from the first gradation voltage and the $N^{th}$ gradation voltage, the second through $N-1^{th}$ gradation voltages generated based on first through $M^{th}$ gamma voltages generated by distributing voltages between the second highest reference voltage and the second lowest reference voltage; and a source driver, which is connected to a plurality of data lines of the display panel and applies data voltages generated based on first through $N^{th}$ gradation voltages to the plurality of data lines, wherein the gradation voltage generator includes a gamma distributor, wherein the first gradation voltage and the $N^{th}$ gradation voltage are output along signal paths that are unconnected to the gamma distributor, and wherein the gradation voltage generator includes:

a first reference voltage selector to select the highest reference voltage, the second highest reference voltage, the lowest reference voltage, and the second lowest reference voltage from among a plurality of first voltages between the first power voltage and the second power voltage;

a second reference voltage selector to receive the highest reference voltage and the lowest reference voltage and to select and output the first gradation voltage and the $N^{th}$ gradation voltage;

a gamma voltage selector to receive the second highest reference voltage and the second lowest reference voltage and to generate the gamma voltages; and a gradation distributor to receive the plurality of gamma voltages and to generate second through $N-1^{th}$ gradation voltages.

22. A display device, comprising:

a display panel;

a gradation voltage generator, which generates a highest reference voltage, a second highest reference voltage, a lowest reference voltage, and a second lowest reference voltage based on a first power voltage and a second power voltage, generates a first gradation voltage and a $N^{th}$ gradation voltage based on the highest reference voltage and the lowest reference voltage, and generates second through $N-1^{th}$ gradation voltages independently from the first gradation voltage and the $N^{th}$ gradation voltage, the second through $N-1^{th}$ gradation voltages generated based on first through $M^{th}$ gamma voltages generated by distributing voltages between the second highest reference voltage and the second lowest reference voltage; and a source driver, which is connected to a plurality of data lines of the display panel and applies data voltages generated based on first through $N^{th}$ gradation voltages to the plurality of data lines, wherein the gradation voltage generator includes a gamma distributor, wherein the first gradation voltage and the $N^{th}$ gradation voltage are output along signal paths that are unconnected to the gamma distributor, and wherein the gradation voltage generator includes:

a reference voltage selector to select the highest reference voltage and the lowest reference voltage from among a plurality of first voltages between the first power voltage and the second power voltage and to output the highest reference voltage and the lowest reference voltage as the first gradation voltage and the $N^{th}$ gradation voltage and to select and output the second highest reference voltage and the second lowest reference voltage from among the plurality of first voltages;

a slope selector to receive, which receives the second highest reference voltage and the second lowest reference voltage and to select and output a first intermediate voltage and a second intermediate voltage;

a gamma voltage selector to receive the second highest reference voltage, the second lowest reference voltage, the first intermediate voltage, and the second intermediate voltage and to generate the plurality of gamma voltages; and a gradation distributor to receive the plurality of gamma voltages and to generate the second through $N-1^{th}$ gradation voltages.

* * * * *